United States Patent [19]

Erickson

[11] 4,047,581

[45] Sept. 13, 1977

[54] MULTISTAGE, DOWNHOLE, TURBO-POWERED INTENSIFIER FOR DRILLING PETROLEUM WELLS

[75] Inventor: John W. Erickson, Huntington Beach, Calif.

[73] Assignee: Kobe, Inc., Huntington Park, Calif.

[21] Appl. No.: 746,408

[22] Filed: Dec. 1, 1976

[51] Int. Cl.[2] ..... E21B 3/08

[52] U.S. Cl. ..... 175/95; 175/107

[58] Field of Search ..... 175/93, 95, 96, 107

[56] References Cited

U.S. PATENT DOCUMENTS

| | | | |
|---|---|---|---|
| 2,908,534 | 10/1959 | Rietsch | 175/107 |
| 3,112,800 | 12/1963 | Bobo | 175/217 |
| 3,894,818 | 7/1975 | Tschirky | 175/107 |
| 3,912,426 | 10/1975 | Tschirky | 175/107 |

*Primary Examiner*—James A. Leppink

*Attorney, Agent, or Firm*—Christie, Parker & Hale

[57] ABSTRACT

A turbine-powered intensifier assembly is a part of a drill collar and attaches to the downhole end of a drill string. A drilling mud stream from the drill string branches. One branch is cleaned of solid matter by centrifugal cleaners. The clean fluid drives the turbines of several stages of turbine-pump intensification and a turbine drive of the centrifugal cleaners. The turbine intakes are in parallel. Each turbine drives a pump and the pumps are staged in series so that the output of one pump becomes the input of a downstream pump. The clean fluid also supplies the pump fluid. The discharge of the final pump stage exhausts into nozzles which direct the fluid against bore hole rock at extremely high pressures and erodes the rock. Turbine exhaust and drilling mud not used in the intensification empties into the rock erosion zone to clear it of chips formed by the drilling. Fluid from this zone and dirty fluid from the cleaners pass up the annulus between the bore hole and the drill string.

19 Claims, 4 Drawing Figures

Fig. 1
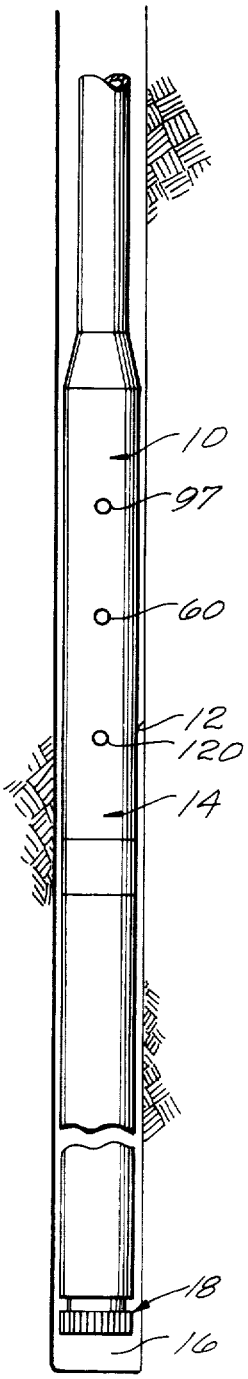
Fig. 2
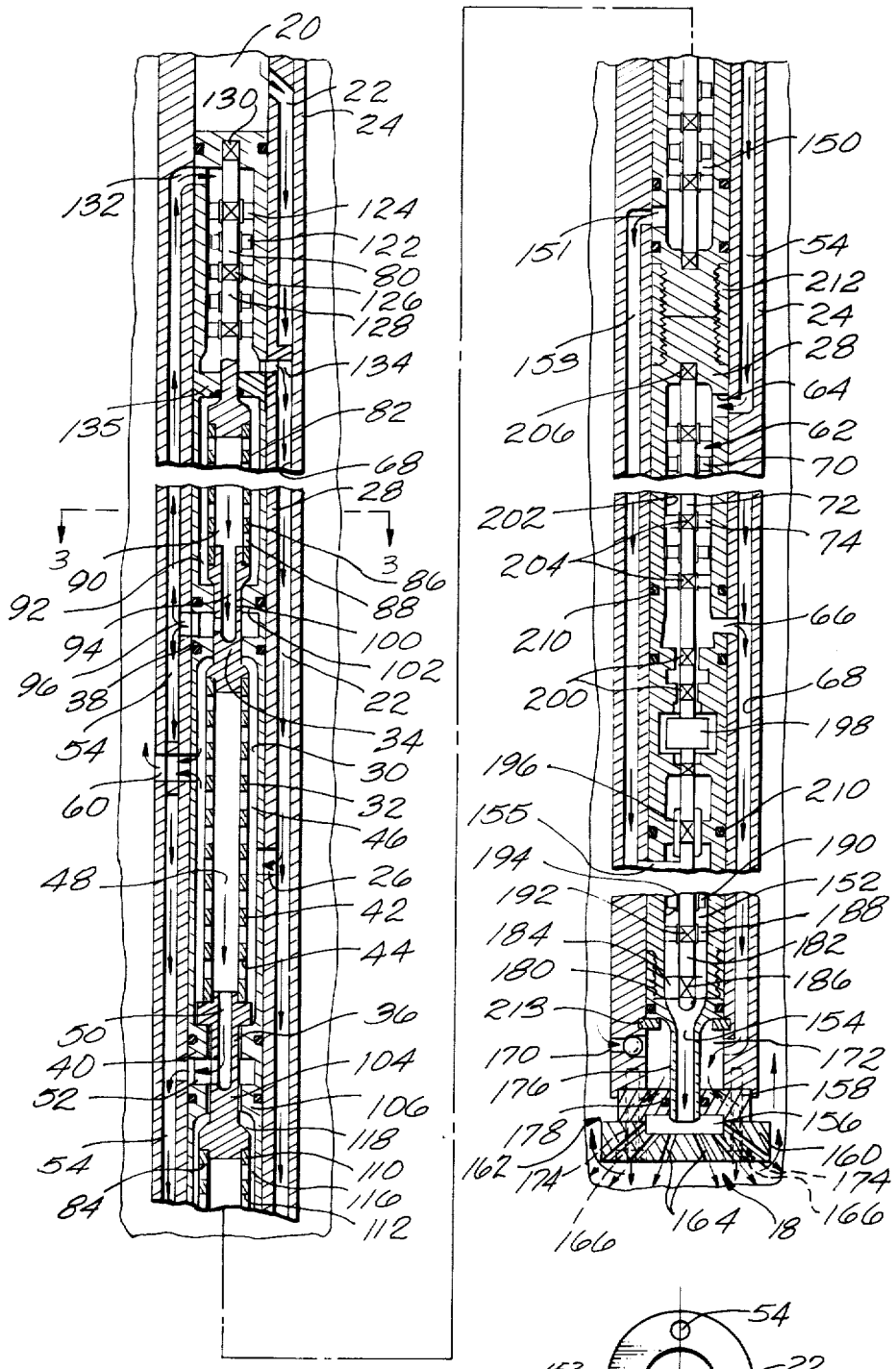
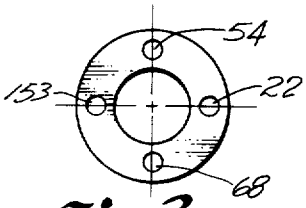
Fig. 3

MULTISTAGE, DOWNHOLE, TURBO-POWERED INTENSIFIER FOR DRILLING PETROLEUM WELLS

BACKGROUND OF THE INVENTION

The present invention relates to high pressure, fluid drilling of rock.

It is known that rock can be drilled by fluid at extremely high pressure. The fluid erodes the rock away. These fluid drills operate at pressures of the order of 5,000 Kg/cm$^2$ with a jet velocity of the order of 200 to 1,000 m/sec.

Proposed techniques for exploiting this technique of rock penetration in petroleum well formation have recognized and sought to use the high total head of drilling mud available in the zone where rock erosion is to take place. The head can represent several thousands of meters of dense drilling mud. These techniques have also recognized the use of drilling mud to clear out rock chips formed during rock erosion.

U.S. Pat. No. 3,112,800 to Bobo describes a downwell drilling technique. This patent describes a fluid-operated motor and pump near the bottom of a well. The pump provides high pressure fluid discharged as a jet to erode rock in the bore hole. The pump described in the Bobo patent is a reciprocating pump of the piston type.

Downhole turbines have also been used in drilling. Thus a power turbine has been used to drive a drill bit. An example of this is U.S. Pat. No. 2,908,534 to Rietsch.

Drilling mud is a dense fluid used to seal formation fluids in the ground and prevent them from blowing out the well. Drilling mud contains solids which erode pump and turbine parts. To use drilling mud also as a working and power fluid for downhole equipment requires that the solids of the mud be removed.

SUMMARY OF THE INVENTION

The present invention provides a pressure intensifier for use in erosive drilling of rock in petroleum well drilling characterized in the use of a plurality of stages of turbines powered by parallel streams of power fluid and a plurality of pumps driven by the turbines and serially staged with respect to the fluid pumped. The source of power fluid for the turbines can provide the pumped fluid. The exhaust from the final pump stage supplies nozzles which direct fluid at the bore hole walls and increase the velocity head of fluid. Exhausted power fluid of the turbines can be used to flush chips and cuttings of the zone of erosion. Preferably the power fluid, pump fluid, and chip flushing fluid all have as their origin drilling mud.

A specific form of the present invention contemplates a plurality of centrifugal cleaners driven by a cleaner drive turbine. Drilling mud passes radially inward of rotors of the cleaners. Clean fluid is taken off axially of the cleaners and forms the feed for all turbines of the device as well as the pumps. A pressure difference across the walls of the cleaner rotors admits the passage of fluid radially inward through the rotor walls. Solid material suspended in the fluid has a density greater than the fluid and centrifugal force on the solid material results in a pressure differential acting on the solid material in a direction opposite the fluid. The solid material accumulates outside the rotors. This type of centrifuge is described in U.S. Pat. Nos. 3,400,819 to Burdyn and 3,433,312 to Burdyn and Nelson. The clean fluid output of the cleaners, still at high pressure, is the power fluid for the cleaner turbine, which is disposed axially of the cleaners. The clean fluid output also powers intensifier turbines. The power fluid to the intensifier turbines is in parallel streams. The exhaust from all the turbines is manifolded for discharge into the zone of rock erosion, in the vicinity of the nozzles, for cleaning chips out of the zone and transporting them up the annulus to outside of the well. The exhaust of the turbines augments drilling mud in this function. All turbines are axially oriented in the drill stream but receive their input fluid in parallel. The intensifier turbines drive rotary pumps with each intensifier turbine having a pump. The pumps are axially aligned with the turbines. The input fluid for the first stage pump comes from the cleaner. The exit fluid of the first stage pump feeds the second stage pump and so on for all the stages. The pumps are then in series fluid circuit. The exhaust from the last stage pump feeds nozzles which impinge and erode the rock formation of the bore hole.

The present invention provides a pressure intensifier for jet rock drilling which is capable of being powered largely by the substantial total head available in typical bore holes. The turbines and pumps are axially aligned, the manifolding to the turbines and pumps easily accommodates in a small radial dimension. The overall radial dimension is accordingly quite small, as is necessary in deep well drilling. The pressure intensification is continuous and not in pulses. Accordingly, the rate of drilling can be substantial. Power and pumped fluid can be easily cleaned downhole.

These and other features, aspects and advantages of the present invention will become more apparent from the following description, appended claims and drawings.

BRIEF DESCRIPTION OF THE FIGURES

FIG. 1 illustrates the intensifier assembly for jet rock drilling of the present invention as it appears in a bore hole;

FIG. 2 is an elevational view, foreshortened in places, and in half-section, illustrating the intensifier assembly for jet rock drilling of the present invention;

FIG. 3 is a view taken at an axial location along the intensifier to show fluid manifolding.

DESCRIPTION OF THE PREFERRED EMBODIMENT

Figure 4:
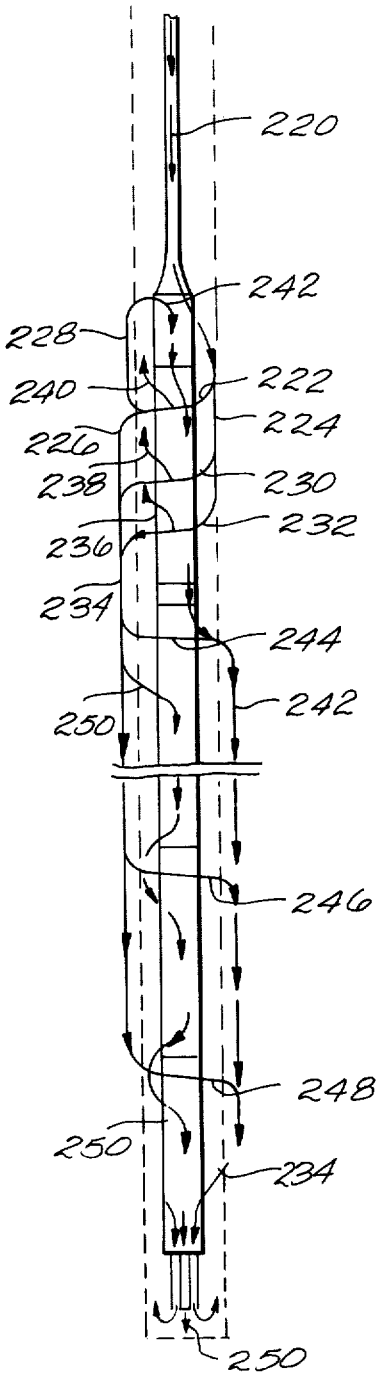
FIG. 4 is a view similar to FIG. 1 illustrating the flow of fluid in the intensifier assembly.

With reference to FIG. 1, a drill string 10 is at the bottom of a bore hole 12. An intensifier assembly 14 of the present invention is the lower end of the drill string. The intensifier includes turbines staged in parallel and rotary pumps staged in series. The turbines drive the pumps and the pumps increase the head of a working fluid used to erode rock of the walls of the bore hole. The power fluid driving the turbines is drilling mud supplied from the surface. This fluid is also the working fluid of the pumps. The mud has a substantial head at typical bore hole bottom locations. Each rotary pump progressively increases the pressure of fluid until there is sufficient pressure for the rock erosion process of drilling. At this time, the last stage pump exits high pressure fluid into a chamber upstream of power nozzles and the fluid passes through the nozzles as jets at extremely high velocity and pressure to erode bore hole material in an erosion zone 16. The erosion zone is the volume in the bore hole and bore hole defining walls which are effectively eroded by the jets of fluid. The increase in head of the fluid in the pump stages is at the expense of the fluid used in driving the turbines. The nozzle assembly is shown at 18 at the very bottom end of the intensifier assembly.

In the specific embodiment illustrated there are five stages of intensification with each stage having a turbine and a pump. The exhaust from the turbines goes into the erosion zone to flush and carry chips and bore hole wall detritus away from the erosion zone. Drilling mud that has bypassed the turbines and pumps and the fluid from the nozzles combine with turbine exhaust for this flushing and transport.

In the embodiment of the invention illustrated, the turbine power fluid and the pump working fluid is drilling mud cleaned of solid materials so that the blades of these turbo-machines are not eroded. A cleaner turbine powers centrifugal cleaners with the power fluid of the cleaner turbine itself being drilling mud cleansed of solid material by the centrifugal cleaner.

With reference to FIG. 2 an axial passage 20 within the drill string provides the passage for drilling mud. A longitudinally extending passage 22 extends along the outside of the intensifier assembly in a sleeve 24 and generally parallel to the axis of the assembly to supply drilling mud to the cleaner and to supply mud for flushing and transporting eroded bore hole material. In FIG. 2 the intensifier assembly has been rotated at intervals 90° to show additional fluid passages and so the entire longitudinal extent of passage 22 is not explicitly illustrated. Drilling mud in passage 22 passes radially inward through ports 26 in the walls of sleeve 24 and a casing 28 into an axial chamber 30. A centrifuge rotor 32 in the chamber mounts in the casing for rotation about the axis of the intensifier assembly. Specifically, the centrifuge rotor has journals at 34 and 36 at its longitudinal ends which mount for rotation about the axis in journal bearings 38 and 40 of casing 28. The centrifuge rotor has a longitudinally extending wall 42 with a plurality of radial ports 44 extending through the wall between an annulus 46 outside the wall and a cavity 48 within the centrifuge rotor and coaxial with the intensifier assembly. An axial passage 50 extends out the bottom of the centrifuge rotor cavity and meets a radial drilling 52 which extends outwardly into a longitudinally extending, power fluid passage 54 that supplies the power fluid for various turbines and also supplies the working fluid for the pumps.

The centrifugal action of centrifuge rotor 32 on drilling mud is described in U.S. Pat. Nos. 3,400,819 to Burdyn and 3,433,312 to Burdyn and Nelson. In general, fluid is urged radially towards the axis of the rotating centrifugal rotor by a pressure gradient. Centrifugal force on the fluid imparted by the centrifugal rotor opposes this gradient. The gradient, however, dominates and is sufficient to force the fluid through the perforations in the wall of the centrifugal rotor. Heavier solid material, however, is forced outside of the cylinder because centrifugal force on it is greater than the opposing force caused by the pressure gradient. This causes separation of solid and liquid and results in a cleaned fluid effluent exiting along the axis of the centrifugal rotor.

Fluid with entrained solids leaves annulus 46 through a port 60 in the wall of casing 28 and sleeve 24.

The clean effluent drives all the turbines and is plumbed to these turbines in parallel. Power fluid passage 54 from the discharge of the cleaner supplies the power fluid to the intakes to the turbines. A turbine 62 receives power fluid from passage 54 through a radial port 64 formed in sleeve 24 and casing 28. The exhaust of this turbine exits radially through a port 66 and into a passage 68 for its use in flushing and transporting drilling waste from the erosion zone. Passage 68 extends longitudinally of the intensifier assembly in sleeve 24. Port 66 extends radially between passage 68 and the exhaust side of turbine 62 through sleeve 24 and casing 28. The turbine itself has blades 70 circularly arrayed about the axis of a turbine shaft 72, which itself lies on the axis of the intensifier assembly. These blades alternate between circularly arrayed stator flow guide blades 74 on casing 28. There are several turbines, say six. Each of the turbines, as well as each of the pumps, is axial flow, multiple stage.

There may be several stages of cleaning. Three are illustrated in the Figures. Thus a turbine 80 drives centrifuge rotors 82, 32 and 84. These centrifuges are plumbed in parallel so that drilling mud supply to them is supplied at the same pressure and the discharges from them are at the same pressure. The feed, cleansing action, and discharge of each centrifugal rotor is functionally equivalent to the corresponding functions of centrifuge rotor 32. Dirty fluid with separated solid material goes up to the well head in the annulus between the drilling string and the bore hole. At the surface the dirty fluid is processed to get rid of drilling waste and recycled.

Centrifuge rotor 82 has a wall 86 with ports 88 through it. The wall separates a central cavity 90 from an outer annulus 92. Cleaned fluid gathered in cavity 90 passes axially through axial passage 94 and radially out a discharge port 96 in the wall of the casing and sleeve into passage 54. Dirty fluid from centrifuge rotor 82 exits from the drill string at a port 97. Centrifuge rotor 82 has a journal 100 in journal bearing 102 of casing 28. Journal 100 and journal 34 of centrifuge rotor 32 are integral and part of a common connecting shaft between the centrifuge rotors. Similarly, a journal 104 of centrifuge rotor 84 journals in a journal bearing 106 of casing 28. Journals 104 and 36 are on a common shaft between joining centrifugal rotors.

Centrifugal rotor 84 has a wall 110 with ports 112 separating an axial cavity 114 from an annulus 116, all within a common chamber 118. The dirty fluid from centrifugal rotor 84 discharges out port 120 (FIG. 1).

Turbine 80 drives all three centrifugal rotors. The turbine has circularly arrayed, multistage blades 122 driven by clean fluid from passage 54. Stator guide blades 124 orient this power fluid for blades 122. Bearings 126 between turbine shaft 128 and the stator blades retain the shaft radially. A thrust bearing 130 between the shaft and casing 28 transfers axial forces from the shaft to the casing. An inlet port 132 through sleeve 24 and casing 28 admits power fluid from passage 54 to the turbine. An exit port 134 through the casing and sleeve discharges power fluid exhaust from the turbine into passage 68. A radial wall 135 of the casing seals off the turbine from the pumps it drives.

The fluid cleaned in the cleaner stages also supplies the working fluid of the various pump stages.

Thus the fluid from the cleaners passes through passage 54 into the first stage pump inlet and its pressure is raised, and it discharges out radial ports into a lengthwise passage to the next or second stage pump. The exhaust of the first stage pump becomes the intake fluid to the second stage pump. This serial progression of fluid flow and pumped or working fluid head increase continues through the last pump stage. The next to the last and last pump stages are expressly shown at 150 and 152 and will be described in detail subsequently. The discharge of pump stage 150 passes through a radial port 151 in the casing and sleeve into passage 153. The working fluid in passage 153 enters last stage pump 152 through radial port 155 in the casing and sleeve. Pump stage 152 of the pumps exhausts into an axial passage 154, which empties into a disc-shaped cavity 156 sandwiched between two carbide plates 158 and 160 of a nozzle assembly 162. Nozzles 164 are oriented at various angles from the axis of the intensifier assembly so that the fluid they discharge impinges against the walls of the bore hole over a substantial area. The pressure at discharge can be on the order of 50,000 p.s.i.

The nozzle assembly, including the carbide plates, fasten on the end of the drill string by any convenient means, for example, screws 166. As stated previously, turbine exhaust and additional drilling mud carry away chips and other formation materials formed as products of erosion during the drilling process. This waste is carried up the annulus between the bore hole and the drill string. In the normal course, turbine exhaust reaches an annulus 172 by passage 68 exiting into it. Turbine exhaust will then flow out of annulus 172 and into the erosion zone through passages 174, shown in phantom, in the carbide plates.

A check valve 170 in the base of the intensifier assembly allows reverse flowing power fluid to enter annulus 172 and force the intensifier assembly within the sleeve up the drill string for renewal. This is done in a manner similar to the free pump described in U.S. Pat. No. 2,338,903 to Coberly. The turbines, pumps and cleaners together with their casing are removable as a unit. The sleeve stays behind.

The pump of the last intensifier stage has a nose 176 which defines exit passage 154. An O-ring 178 on upper carbide plate 158 seals the interfaces between the nose and the plate. The nose threads onto the base of casing 28 at 180. Common turbine and pump shaft 72 mounts for rotation in a spider 184. A bearing 186 between the spider and the shaft takes axial and radial loads. The spider has circularly arrayed and spaced-apart struts to transfer radial loads of shaft 182 to casing 28. Longitudinal passages between the struts pass pumped fluid.

Pump stage 152 has alternate circularly arrayed stator blades 188 and impeller blades 190 in a standard fashion. Journal bearings 192 between shaft 182 and the stator blades take radial loads. The pump impeller blades, stator blades and shaft are all in a chamber 194 within casing 28.

A balance piston 196 between chamber 194 of the pump and the turbine side of this intensifier stage has opposing areas to reduce the axial load on a thrust bearing 198 carried by shaft 72. The upper area of the piston sees turbine exhaust pressure and the lower area sees pump inlet pressure, which is higher. The bearing takes what axial load is not balanced and transmits the load from the shaft to casing 28. Journals 200 between the shaft and the casing transmit radial loads.

Last stage turbine 62 has its axially staggered stator and turbine blades 74 and 70 in a chamber 202 of casing 28. Journals 204 between the stator blades and shaft 182 take radial forces. A thrust bearing 206 between casing 28 and shaft 72 takes axial loads acting upwardly. O-rings 210 occupy periodic longitudinal stations along the interface between the casing and the sleeve to prevent leakage along the interface.

Casing 28 forms of several longitudinally aligned and attached sections. The sections attach together at thread joints of male threaded plugs and female threaded couplers as shown at 212. The casing is held in place in sleeve 24 by a key 213 abutting the bottom of the casing and received in a groove in the wall of the sleeve. The sleeve may be formed in longitudinal sections and have longitudinal drillings for the fluid passages.

The construction of the last intensifier stage repeats itself with the other intensifier stages.

FIG. 3 shows the true circular orientation of the fluid passages in sleeve 24. Turbine exhaust passage 22, turbine inlet passage 54, cleaner inlet passage 68, and interpump passage 153 show there.

The plumbing of the intensifier assembly is shown to best effect in FIG. 4. The various streams are renumbered to avoid confusion with structure. A drilling mud stream 220 flows vertically in the drill string. It branches into branch streams 222 and 224 for parallel cleaning in the three centrifugal cleaners. Stream 222 is cleaned and then branches at 226 and 228. Clean stream 228 drives the turbine for the cleaners. Stream 224 branches at 230 and 232. Streams 230 and 232 are the fluid streams for the remaining two cleaners. The cleansed fluid from the cleaners unite in a stream 234, which is the power fluid for the various intensifier turbines. Additionally, this fluid forms the working fluid of the pumps for each stage of intensification. Exhaust streams 236, 238 and 240 from the cleaner stages empty into the annulus between the drill string and the bore hole. An exhaust stream 242 comes from the cleaner turbine.

Stream 234 from the cleaners branches to form the parallel feed streams to the intensifier turbines, three of such streams being shown at 244, 246 and 248. A fourth branch stream 250 from stream 234 forms the intensifier pumps' stream. This stream feeds the pumps in series. The exhaust from the intensifier turbines combines in stream 242, which empties into the erosion zone for chip flushing and transport from the zone.

The present invention has been described with reference to a preferred embodiment. The spirit and scope of the appended claims should not, however, necessarily be limited to the description.

What is claimed is:

1. A multiple stage, downhole, turbine-powered intensifier for drilling petroleum wells comprising:

a. a plurality of turbines aligned along a common axis;

b. a plurality of rotary pumps driven by the plurality of turbines and axially aligned therewith, the pumps and turbines forming an assembly which is long and comparatively small in maximum dimension taken radially of the axis;

c. passage means to supply the turbines with power fluid in parallel streams with each turbine having one of the parallel streams as its input;

d. passage means to exhaust the turbines of the power fluid;

e. passage means to supply the pumps with a working fluid in series so that each pump stage increases the pressure of the working fluid; and f. nozzle means at the base of the intensifier for receiving the working fluid from the last stage pump and directing such fluid at bore hole wells.

2. The intensifier claimed in claim 1 wherein each turbine and each pump is axial flow and mutliple-staged.

3. The intensifier claimed in claim 2 wherein each turbine drives an associated one of the pumps through a common shaft of such turbine and pump, each turbine and pump with a common shaft being an intensification stage, the intensifier having a plurality of such stages with the common shaft of each intensification stage being independent of the common shaft of each other intensification stage.

4. The intensifier claimed in claim 3 including for each intensification stage means to balance axial forces because of fluid pressure.

5. The intensifier claimed in claim 4 wherein the balance means includes a balance piston having opposed areas, one of the areas seeing turbine exhaust pressure acting downwardly and the other area seeing pump inlet pressure acting upwardly.

6. A multiple stage, downhole, turbine-powered intensifier for drilling petroleum wells comprising:

a. a drill collar having a long axial dimension relative to its maximum radial dimension;
b. a plurality of turbine and pump intensifier stages of the drill collar, each intensifier stage having at least one axial flow turbine, at least one axial flow pump, and shaft means coupling the turbine to the pump;
c. power fluid passage means in the drill collar to each of the turbines, the power fluid passage means supplying the turbines with power fluid in parallel so that each turbine sees the same inlet pressure;
d. turbine exhaust passage means in the drill collar from each of the turbines;
e. working fluid passage means in the drill collar to each of the pumps, the working fluid passage means supplying the pumps with working fluid in series so that the pressure of the working fluid increases after each of the pumps; and
f. nozzle means at the base of the drill collar for receiving the working fluid from the last intensifier stage and directing such fluid at bore hole walls in an erosion zone.

7. The intensifier claimed in claim 6 wherein the drill collar includes an outer sleeve and a casing received by the sleeve, the casing being of the turbines and the pumps, the shaft means of each intensifier stage being rotatably mounted in the casing, each of the turbines and each of the pumps being multiple stage.

8. The intensifier claimed in claim 7 wherein the shaft means of each intensifier stage is independent of the shaft means of each other intensifier stage.

9. The intensifier claimed in claim 8 including balance means in each intensifier stage operable to reduce fluid pressure caused forces acting axially.

10. The intensifier claimed in claim 9 wherein the power fluid passage means, the turbine exhaust passage means, and the working fluid passage means is each substantially in the sleeve.

11. The intensifier claimed in claim 10 wherein the turbine exhaust passage means empties from the drill collar proximate the nozzle means for flushing and transport of eroded bore hole wall material from the erosion zone.

12. A multiple stage, downhole, turbine-powered intensifier for drilling petroleum wells comprising:

a. a drill collar adapted for attachment to the downhole end of a drill string;
b. a plurality of intensifier stages of the drill collar for increasing the pressure of a working fluid, each intensifier stage including an axial flow intensifier turbine, an axial flow intensifier pump, and shaft means for driving the intensifier pump by the intensifier turbine;
c. centrifugal cleaner means of the drill collar for removing solids from drilling mud and forming a cleansed stream;
d. a cleaner turbine of the drill collar for driving the centrifugal cleaner means;
e. drilling mud passage means from the drill string to the inlet of the centrifugal cleaner means;
f. cleansed fluid passage means from the centrifugal cleaners for fluid cleansed thereby;
g. dirty fluid passage means from the centrifugal cleaner means for discharging fluid containing the solids from the drill collar;
h. power fluid passage means from the cleansed fluid passage means for driving the cleaner turbine;
i. power fluid passage means from the cleansed fluid passage means to drive intensifier turbines, the power fluid passage means being in parallel to the intensifier turbines so that each turbine sees the same inlet pressure;
j. exhaust passage means from the intensifier turbines and cleaner turbine;
k. working fluid passage means from the cleansed fluid passage means to each of the intensifier pumps, the working fluid passage means being in series between the pumps so that the pressure of the working fluid increases after each pump; and
l. nozzle means at the base of the drill collar for receiving the working fluid from the last intensifier stage and directing such fluid at bore hole walls in an erosion zone.

13. The intensifier claimed in claim 12 wherein the exhaust passage means from the intensifier turbines and cleaner turbine ends proximate the erosion zone so that exhaust fluid flushes and carries from such zone products of erosion.

14. The intensifier claimed in claim 13 wherein the dirty fluid passage means exits from the drill collar remote from the erosion zone for passage of dirty fluid up an annulus between the drill string and the bore hole wall.

15. The intensifier claimed in claim 14 wherein the drilling mud passage means, cleansed fluid passage means, power fluid passage means, and exhaust fluid passage means all extend substantially completely in the drill collar.

16. The intensifier claimed in claim 13 wherein the shaft means in each intensifier stage is independent of each other shaft means of each other intensifier stage.

17. The intensifier claimed in claim 16 wherein the dirty fluid passage means exits from the drill collar remote from the erosion zone for passage of dirty fluid up an annulus between the drill string and the bore hole wall.

18. The intensifier claimed in claim 17 wherein the drilling mud passage means, cleansed fluid passage means, power fluid passage means, and exhaust fluid passage means all extend substantially completely in the drill collar.

19. The intensifier claimed in claim 18 including balance means in each intensifier stage operable to reduce fluid pressure caused forces acting axially.

* * * * *